US011462160B2

(12) United States Patent
Cai

(10) Patent No.: US 11,462,160 B2
(45) Date of Patent: Oct. 4, 2022

(54) ORGANIC LIGHT EMITTING DIODE DISPLAY PANEL AND DISPLAY DEVICE

(71) Applicant: WUHAN CHINA STAR OPTOELECTRONICS SEMICONDUCTOR DISPLAY TECHNOLOGY CO., LTD., Hubei (CN)

(72) Inventor: Zhenfei Cai, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 110 days.

(21) Appl. No.: 17/057,385

(22) PCT Filed: Jun. 10, 2020

(86) PCT No.: PCT/CN2020/095283
§ 371 (c)(1),
(2) Date: Nov. 20, 2020

(87) PCT Pub. No.: WO2021/227167
PCT Pub. Date: Nov. 18, 2021

(65) Prior Publication Data

US 2022/0189396 A1 Jun. 16, 2022

(30) Foreign Application Priority Data

May 12, 2020 (CN) ..... 202010397803.0

(51) Int. Cl.
*G09G 3/3233* (2016.01)
*G09G 3/00* (2006.01)

(52) U.S. Cl.
CPC ..... *G09G 3/3233* (2013.01); *G09G 3/035* (2020.08); *G09G 2300/043* (2013.01);
(Continued)

(58) Field of Classification Search
None
See application file for complete search history.

(56) References Cited

U.S. PATENT DOCUMENTS

2003/0137503 A1 7/2003 Kimura et al.
2014/0176516 A1* 6/2014 Kim ..... G09G 3/3233 345/204

(Continued)

FOREIGN PATENT DOCUMENTS

CN 104217681 A 12/2014
CN 107437400 A 12/2017

(Continued)

*Primary Examiner* — Dorothy Harris

(57) ABSTRACT

An organic light emitting diode (OLED) display panel and a display device are provided. A first pixel driving circuit of the is configured to compensate a threshold voltage of a drive transistor in the bending area during a first time period before starting up or a second time period after shutting down. A second pixel driving circuit is configured to compensate a threshold voltage of a drive transistor in the non-bending area during a blank time period between adjacent display frames. A duration of the first time period and a duration of the second time period are both greater than a duration of the blank time period. A brightness of the display panel is uniform.

18 Claims, 3 Drawing Sheets

(52) U.S. Cl.
CPC ..... *G09G 2300/0842* (2013.01); *G09G 2300/0852* (2013.01); *G09G 2300/0861* (2013.01); *G09G 2310/0251* (2013.01); *G09G 2310/08* (2013.01); *G09G 2320/0233* (2013.01); *G09G 2320/045* (2013.01)

(56) References Cited

U.S. PATENT DOCUMENTS

| | | | | |
|---|---|---|---|---|
| 2015/0154908 | A1* | 6/2015 | Nam | G09G 3/3233 345/76 |
| 2016/0321988 | A1 | 11/2016 | Yang et al. | |
| 2017/0092195 | A1* | 3/2017 | Jung | G09G 3/3258 |
| 2017/0124947 | A1* | 5/2017 | Kim | G09G 3/3233 |
| 2019/0073946 | A1* | 3/2019 | Su | H01L 27/3262 |
| 2019/0103060 | A1* | 4/2019 | Kang | H01L 27/124 |
| 2020/0020278 | A1* | 1/2020 | Lee | G09G 3/3275 |
| 2021/0335262 | A1* | 10/2021 | Wu | G09G 3/3291 |

FOREIGN PATENT DOCUMENTS

| | | | |
|---|---|---|---|
| CN | 108766249 | A | 11/2018 |
| CN | 110322836 | A | 10/2019 |
| CN | 110827763 | A | 2/2020 |
| CN | 110910816 | A | 3/2020 |
| JP | 2006010897 | A | 1/2006 |
| KR | 20010064562 | A | 7/2001 |

* cited by examiner

ORGANIC LIGHT EMITTING DIODE DISPLAY PANEL AND DISPLAY DEVICE

FIELD OF DISCLOSURE

This present disclosure relates to the field of display technologies, and in particular to an organic light emitting diode (OLED) display panel and a display device.

BACKGROUND

In existing active-matrix organic light emitting diode (AMOLED) display panels, a threshold voltage Vth of a transistor will drift due to various reasons, so the threshold voltage Vth needs to be compensated by a pixel driving circuit. For a small-sized foldable display panel, due a bending area is subject to stress changes for a long time, a threshold voltage Vth of each transistor in the bending area is very prone to change, and the change is greater than that in a non-bending area. A voltage range required for compensation is also larger. The pixel driving circuit currently adopted is internal compensation, and the threshold voltage Vth is compensated during a blank time period between display frames. Due to a short compensation time, a compensation range is only about plus/minus 0.5 v, which makes it difficult to meet compensation requirements of the bending area. Therefore, it is difficult to make a display brightness of the bending area and a display brightness of the non-bending area uniform. In the bending area, the brightness of the display panel will change significantly, and the current compensation method cannot completely eliminate a brightness difference.

Accordingly, the existing OLED display panel has a technical problem that the brightness of the bending area is different from that of the non-bending area, which needs to be improved.

SUMMARY OF DISCLOSURE

Embodiments of the present disclosure provide an OLED display panel and a display device to solve the technical problem of the different brightness of the bending area and the non-bending area in the existing OLED display panel.

To solve the above problems, technical solutions provided by the present disclosure are as follows.

An embodiment of the present disclosure provides an organic light emitting diode (OLED) display panel, including a bending area and a non-bending area. The OLED display panel includes:

a first pixel driving circuit configured to compensate a threshold voltage of a drive transistor in the bending area during a first time period before starting up or a second time period after shutting down; and a second pixel driving circuit configured to compensate a threshold voltage of a drive transistor in the non-bending area during a blank time period between adjacent display frames.

A duration of the first time period and a duration of the second time period are both greater than a duration of the blank time period.

In the OLED display panel of the present disclosure, the first pixel driving circuit includes a first data signal input module, a first drive module, a first detection module, and a first storage module. The first data signal input module is configured to provide a first data signal to a first node under control of a first control signal. The first drive module is configured to drive a first light emitting device to emit light under control of a potential of the first node. The first detection module is connected to the first drive module through a second node, and is configured to detect a threshold voltage of the first drive module under control of a second control signal. The first storage module is connected to the first drive module through the first node and the second node, and is configured to store the threshold voltage of the first drive module. The first data signal input module is also configured to provide a compensated second data signal to the first node according to the threshold voltage detected by the first detection module.

In the OLED display panel of the present disclosure, the first data signal input module includes a first transistor, a gate of the first transistor is connected to the first control signal, a first electrode of the first transistor is connected to a data line, and a second electrode of the first transistor is connected to the first node.

In the OLED display panel of the present disclosure, the first drive module includes a second transistor, a gate of the second transistor is connected to the first node, a first electrode of the second transistor is connected to a first power signal, and a second electrode of the second transistor is connected to the first light emitting device.

In the OLED display panel of the present disclosure, the first detection module includes a third transistor, a sensing line, and a single-pole double-throw switch, a gate of the third transistor is connected to the second control signal, a first electrode of the third transistor is connected to the second node, a second electrode of the third transistor is connected to a first terminal of the sensing line, a movable contact of the single-pole double-throw switch is connected to a second terminal of the sensing line, a first stationary contact of the single-pole double-throw switch is connected to a first initial voltage signal, and a second stationary contact of the single-pole double-throw switch is connected to an analog-to-digital converter.

In the OLED display panel of the present disclosure, the first storage module includes a first storage capacitor, a first electrode plate of the first storage capacitor is connected to the first node, and a second electrode plate of the first storage capacitor is connected to the second node.

In the OLED display panel of the present disclosure, the second pixel driving circuit includes a second data signal input module, a second drive module, a second detection module, and a second storage module. The second data signal input module is configured to provide a reference voltage signal to a third node in a threshold voltage acquire stage and to provide a third data signal to the third node in a data writing stage under control of a third control signal. The second drive module is configured to drive a second light emitting device to emit light under control of a fourth control signal and a potential of the third node. The second detection module is connected to the second drive module through a fourth node, and is configured to detect a threshold voltage of the second drive module in the threshold voltage acquire stage under control of a fifth control signal. The second storage module is connected to the second drive module through the third node and a fifth node, and is configured to store the threshold voltage of the second drive module.

In the OLED display panel of the present disclosure, the second data signal input module includes a fourth transistor, the second drive module includes a fifth transistor and a sixth transistor, a gate of the fourth transistor is connected to the third control signal, a first electrode of the fourth transistor is connected to a data line, a second electrode of the fourth transistor is connected to the third node, a gate of the fifth transistor is connected to the third node, a first electrode of the fifth transistor is connected to the second light emitting device, a second electrode of the fifth transistor is connected to a first electrode of the sixth transistor, a gate of the sixth transistor is connected to the fourth control signal, and a second electrode of the sixth transistor is connected to a first power signal through the fifth node.

In the OLED display panel of the present disclosure, the second detection module includes a seventh transistor, a gate of the seventh transistor is connected to the fifth transistor, a first electrode of the seventh transistor is connected to a second initial voltage signal, and a second electrode of the seventh transistor is connected to the fourth node.

In the OLED display panel of the present disclosure, the second storage module includes a second storage capacitor and a third storage capacitor, a first electrode plate of the second storage capacitor is connected to the third node, a second electrode plate of the second storage capacitor and a first electrode plate of the third storage capacitor are connected to the second light emitting device through the fourth node, and a second electrode plate of the third storage capacitor is connected to the fifth node.

The present disclosure also provides a display device, including an organic light emitting diode (OLED) display panel and a driver chip. The OLED display panel includes a bending area and a non-bending area, and the OLED display panel includes:

a first pixel driving circuit configured to compensate a threshold voltage of a drive transistor in the bending area during a first time period before starting up or a second time period after shutting down; and a second pixel driving circuit configured to compensate a threshold voltage of a drive transistor in the non-bending area during a blank time period between adjacent display frames.

A duration of the first time period and a duration of the second time period are both greater than a duration of the blank time period.

In the display device of the present disclosure, the first pixel driving circuit includes a first data signal input module, a first drive module, a first detection module, and a first storage module. The first data signal input module is configured to provide a first data signal to a first node under control of a first control signal. The first drive module is configured to drive a first light emitting device to emit light under control of a potential of the first node. The first detection module is connected to the first drive module through a second node, and is configured to detect a threshold voltage of the first drive module under control of a second control signal. The first storage module is connected to the first drive module through the first node and the second node, and is configured to store the threshold voltage of the first drive module. The first data signal input module is also configured to provide a compensated second data signal to the first node according to the threshold voltage detected by the first detection module.

In the display device of the present disclosure, the first data signal input module includes a first transistor, a gate of the first transistor is connected to the first control signal, a first electrode of the first transistor is connected to a data line, and a second electrode of the first transistor is connected to the first node.

In the display device of the present disclosure, the first drive module includes a second transistor, a gate of the second transistor is connected to the first node, a first electrode of the second transistor is connected to a first power signal, and a second electrode of the second transistor is connected to the first light emitting device.

In the display device of the present disclosure, the first detection module includes a third transistor, a sensing line, and a single-pole double-throw switch, a gate of the third transistor is connected to the second control signal, a first electrode of the third transistor is connected to the second node, a second electrode of the third transistor is connected to a first terminal of the sensing line, a movable contact of the single-pole double-throw switch is connected to a second terminal of the sensing line, a first stationary contact of the single-pole double-throw switch is connected to the first initial voltage signal, and a second stationary contact of the single-pole double-throw switch is connected to an analog-to-digital converter.

In the display device of the present disclosure, the first storage module includes a first storage capacitor, a first electrode plate of the first storage capacitor is connected to the first node, and a second electrode plate of the first storage capacitor is connected to the second node.

In the display device of the present disclosure, the second pixel driving circuit includes a second data signal input module, a second drive module, a second detection module, and a second storage module. The second data signal input module is configured to provide a reference voltage signal to a third node in a threshold voltage acquire stage and to provide a third data signal to the third node in a data writing stage under control of a third control signal. The second drive module is configured to drive a second light emitting device to emit light under control of a fourth control signal and a potential of the third node. The second detection module is connected to the second drive module through a fourth node, and is configured to detect a threshold voltage of the second drive module in the threshold voltage acquire stage under control of a fifth control signal. The second storage module is connected to the second drive module through the third node and a fifth node, and is configured to store the threshold voltage of the second drive module.

In the display device of the present disclosure, the second data signal input module includes a fourth transistor, the second drive module includes a fifth transistor and a sixth transistor, a gate of the fourth transistor is connected to the third control signal, a first electrode of the fourth transistor is connected to a data line, a second electrode of the fourth transistor is connected to the third node, a gate of the fifth transistor is connected to the third node, a first electrode of the fifth transistor is connected to the second light emitting device, a second electrode of the fifth transistor is connected to a first electrode of the sixth transistor, a gate of the sixth transistor is connected to the fourth control signal, and a second electrode of the sixth transistor is connected to a first power signal through the fifth node.

In the display device of the present disclosure, the second detection module includes a seventh transistor, a gate of the seventh transistor is connected to the fifth transistor, a first electrode of the seventh transistor is connected to a second initial voltage signal, and a second electrode of the seventh transistor is connected to the fourth node.

In the display device of the present disclosure, the second storage module includes a second storage capacitor and a third storage capacitor, a first electrode plate of the second storage capacitor is connected to the third node, and a second electrode plate of the second storage capacitor and a first electrode plate of the third storage capacitor are connected to the second light emitting device through the fourth node, and a second electrode plate of the third storage capacitor is connected to the fifth node.

Advantages of the present disclosure are as follows. The embodiments of the present disclosure provide the OLED display panel and the display device. The OLED display includes the bending area and the non-bending area. The OLED display panel includes the first pixel driving circuit and the second pixel driving circuit. The first pixel driving circuit is configured to compensate the threshold voltage of the drive transistor in the bending area during the first time period before starting up or the second time period after shutting down. The second pixel driving circuit is configured to compensate the threshold voltage of the drive transistor in the non-bending area during the blank time period between adjacent display frames. The duration of the first time period and the duration of the second time period are both greater than the duration of the blank time period. The present disclosure compensates the threshold voltage by using different pixel drive circuits for the bending area and the non-bending area. Since a compensation time of the first pixel driving circuit in the bending area is longer, a compensation voltage range will be larger, so it can meet compensation range requirements in the bending area. Thus, a brightness of the bending area and a brightness of the non-bending area are the same, so that the brightness of an entire display panel is uniform.

BRIEF DESCRIPTION OF DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

DETAILED DESCRIPTION

The following embodiments are referring to the accompanying drawings for exemplifying specific implementable embodiments of the present disclosure. Furthermore, directional terms described by the present disclosure, such as upper, lower, front, back, left, right, inner, outer, side and etc., are only directions by referring to the accompanying drawings, and thus the used directional terms are configured to describe and understand the present disclosure, but the present disclosure is not limited thereto.

An embodiment of the present disclosure provides an OLED display panel and a display device to solve a technical problem of different brightness of a bending area and a non-bending area in an existing OLED display panel.

The present disclosure provides an OLED display panel, including a bending area and a non-bending area. The OLED display panel further includes a first pixel driving circuit and second pixel driving circuit.

The first pixel driving circuit is configured to compensate a threshold voltage of a drive transistor in the bending area during a first time period before starting up or a second time period after shutting down.

The second pixel driving circuit is configured to compensate a threshold voltage of a drive transistor in the non-bending area during a blank time period between adjacent display frames.

A duration of the first time period and a duration of the second time period are both greater than a duration of the blank time period.

Figure 1:
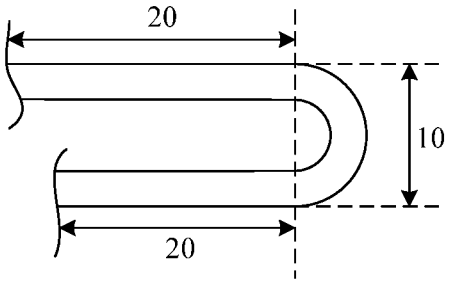
FIG. 1 is a schematic diagram of an OLED display panel of an embodiment of the present disclosure.

As shown in FIG. 1, an OLED display panel includes a bending area 10 and a non-bending area 20. The OLED is provided with a plurality of pixels in both the bending area 10 and the non-bending area 20. Each pixel is driven by a pixel driving circuit to display an image during a display stage. In a detection phase, the pixel driving circuit detects a threshold voltage of a transistor, and performs data signal compensation according to the detected threshold voltage, so that each pixel emits light normally.

Figure 2:
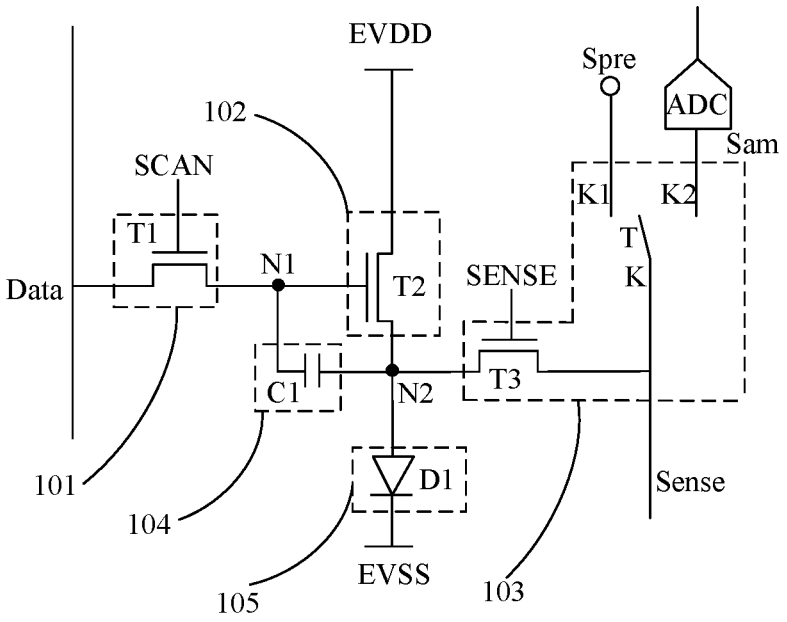
FIG. 2 is a schematic diagram of a first pixel driving circuit of the embodiment of the present disclosure.

The pixels in the bending area 10 are driven by a first pixel driving circuit. As shown in FIG. 2, which is a schematic diagram of the first pixel driving circuit of the embodiment of the present disclosure. The first pixel driving circuit includes a first data signal input module 101, a first drive module 102, a first detection module 103, and a first storage module 104. The first data signal input module 101 is configured to input a first data signal to a first node N1 under a control of a first control signal SCAN. The first drive module 102 is configured to drive the first light emitting device 105 to emit light under a control of an electric potential of the first node N1. The first detection module 103 is connected to the first drive module 102 through a second node N2, and is configured to detect a threshold voltage of the first drive module 102 under a control of a second control signal SENSE. The first storage module 104 is connected to the first drive module 102 through the first node N1 and the second node N2, and is configured to store the threshold voltage of the first drive module 102. The first data signal input module 101 is also configured to input a compensated second data signal to the first node N1 according to the threshold voltage detected by the first detection module 103.

Specifically, the first data signal input module 101 includes a first transistor T1. A gate of the first transistor T1 is provided with the first control signal SCAN. A first electrode of the first transistor T1 is connected to a data line Data. A second electrode of the first transistor T1 is connected to the first node N1.

The first drive module 102 includes a second transistor T2. A gate of the second transistor T2 is connected to the first node N1. A first electrode of the second transistor T2 is provided with a first power signal EVDD. A second electrode of the second transistor T2 is connected to the first light emitting device 105.

The first detection module 103 includes a third transistor T3, a sensing line Sense, and a single-pole double-throw switch T. A gate of the third transistor T3 is provided with the second control signal SENSE. A first electrode of the third transistor T3 is connected to the second node N2. A second electrode of the third transistor T3 is connected to a first terminal of the sensing line Sense. A movable contact K of the single-pole double-throw switch T is connected to a second terminal of the sensing line Sense. A first stationary contact K1 of the single-pole double-throw switch T is provided with the first initial voltage signal Spre. A second stationary contact K2 of the single-pole double-throw switch T is connected to an analog-to-digital converter ADC.

The first storage module 104 includes a first storage capacitor C1. A first electrode plate of the first storage capacitor C1 is connected to the first node N1. A second electrode plate of the first storage capacitor C1 is connected to the second node N2.

The first light emitting device 105 includes an organic light emitting diode D1. An anode of the organic light emitting diode D1 is connected to the second node N2. A cathode of the organic light emitting diode D1 is provided with a second power signal EVSS.

In this embodiment, one of the first electrode and the second electrode of each transistor is a source and the other is a drain. The first power signal EVDD is a high potential signal. A second power signal EVSS is a low potential signal. A voltage value output by the first power signal EVDD is greater than a voltage value output by the second power signal EVSS. In the first drive module 103, the second transistor T2 is a drive transistor. A threshold voltage of the first drive module 103 means a threshold voltage Vth of the second transistor T2.

Figure 3:
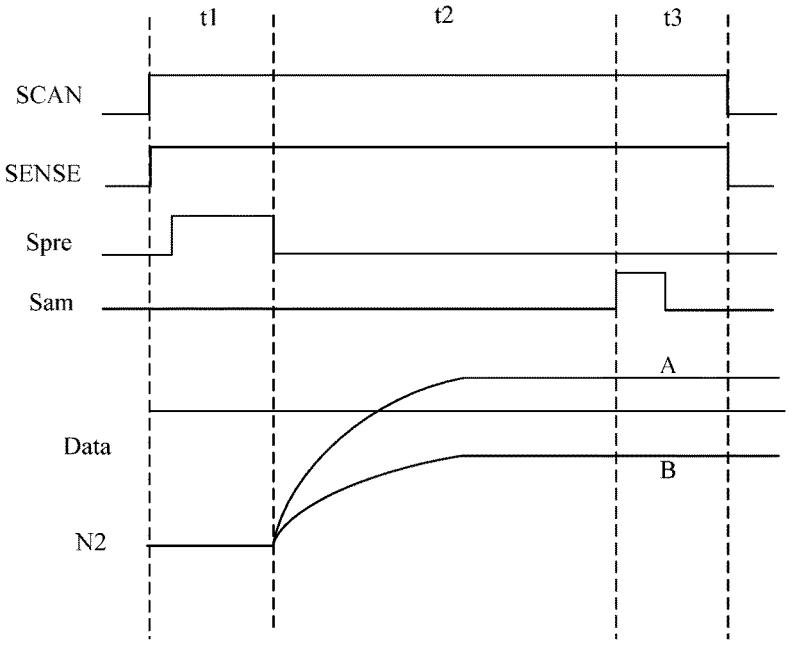
FIG. 3 is a timing diagram showing a detection stage of the first pixel driving circuit of the embodiment of the present disclosure.

FIG. 3 is a timing diagram showing a detection stage of the first pixel driving circuit. The detection stage of the first pixel driving circuit is usually performed during a first time period before the OLED display panel is started or a second time period after the OLED display panel is shutting down. The detection stage includes an initialization stage t1, a charging stage t2, and a voltage detection stage t3.

In the initialization stage t1, the first control signal SCAN is at a high level. The first transistor T1 is turned on. A first data signal Vdata with a high level is input to the first node N1. The second control signal SENSE is at a high level. The third transistor T3 is turned on. The movable contact K of the single-pole double-throw switch T is connected to the first stationary contact K1. A first initial voltage Vpre is input to the second node N2. At this time, a gate voltage of the second transistor T2 is Vdata, and a voltage of the first electrode of the second transistor T2 is Vpre.

In the charging stage t2, the first control signal SCAN maintains at the high level. The first transistor T1 is turned on. The second control signal SENSE maintains at the high level. The third transistor T3 is turned on. The movable contact K of the single-pole double-throw switch T is disconnected from the first stationary contact K1 and the second stationary contact K2. At this time, a voltage of the second node N2 continues to rise, until $V_{N2}$=Vdata−Vth.

When the threshold voltage Vth is negatively biased, a Vdata-Vth difference is larger. Thus, a voltage rise curve of the second node N2 is shown as a curve A in FIG. 2. When the threshold voltage Vth is positively biased, the Vdata-Vth difference is small. Therefore, the voltage rise curve of the second node N2 is shown as a curve B in FIG. 2.

In the voltage detection stage t3, the first control signal SCAN maintains at the high level. The first transistor T1 is turned on. The second control signal SENSE maintains at the high level. The third transistor T3 is turned on. The movable contact K of the single-pole double-throw switch T is connected to the second stationary contact K2. At this time, since the sensing line Sense is connected to the second node N2, a voltage on the sensing line Sense is the same as a voltage of the second node N2. The analog-to-digital converter ADC detects the voltage on the sensing line Sense, generates a corresponding data, and latches it. The detected voltage value Sam is a voltage value of the second node N2, that is, Vdata-Vth.

Since Vdata is a known value in advance, the threshold voltage Vth can be obtained by subtracting the detected voltage Vdata-Vth from the known Vdata.

After the detection is completed, the compensation value used to compensate the threshold voltage is calculated according to the acquired threshold voltage Vth. Also, according to the compensation value, a second data signal Vdata' is determined. The data line Data is configured to adjust an input data signal in a display stage to realize the compensation of the drive transistor.

The detection stage of the first pixel driving circuit is usually performed during the first time period before the OLED display panel is started up or the second time period after the OLED display panel is shutting down. The durations of the first time period and the second time period has nothing to do with a display time. Therefore, it can usually be set long enough, and there is enough time for data line Data to adjust the first data signal to the second data signal. A compensation range for compensation through data line Data is relatively large.

Figure 4:
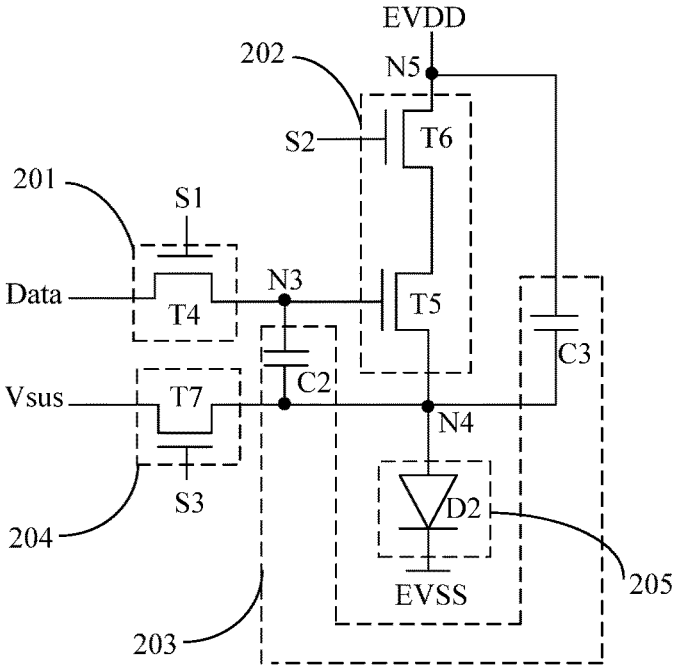
FIG. 4 is a schematic diagram of a second pixel driving circuit of the embodiment of the present disclosure.

FIG. 4 is a schematic diagram of a second pixel driving circuit of the embodiment of the present disclosure. The second pixel driving circuit includes a second data signal input module 201, a second drive module 202, a second detection module 203, and a second storage module 204. The second data signal input module 201 is configured to input a reference voltage signal to a third node N3 in a threshold voltage acquire stage under a control of a third control signal S1. In a data writing stage, a third data signal is input to the third node N3. The second drive module 202 is configured to drive a second light emitting device 205 to emit light under a potential control of a fourth control signal S2 and the third node N3. The second detection module 203 is connected to the second drive module 202 through the fourth node N4, and is configured to detect a threshold voltage of the second drive module 202 in the threshold voltage acquire stage under a control of a fifth control signal S3. The second storage module 204 is connected to the second drive module 202 through the third node N3 and a fifth node N5, and is configured to store the threshold voltage of the second drive module 202.

Specifically, the second data signal input module 201 includes a fourth transistor T4. The second drive module 202 includes a fifth transistor T5 and a sixth transistor T6. A gate of the fourth transistor T4 is provided with the third control signal S1. A first electrode of the fourth transistor T4 is connected to the data line Data. A second electrode of the fourth transistor T4 is connected to the third node N3. A gate of the fifth transistor T5 is connected to the third node N3. A first electrode of the fifth transistor T5 is connected to the second light emitting device 205. A second electrode of the fifth transistor T5 is connected to a first electrode of the sixth transistor T6. A gate of the sixth transistor T6 is provided with a fourth control signal S2. A second electrode of the sixth transistor T6 is provided with the first power signal EVDD through the fifth node N5.

The second detection module 203 includes a seventh transistor T7. A gate of the seventh transistor T7 is connected to the fifth transistor T5. A first electrode of the seventh transistor T7 is provided with a second initial voltage signal Vsus. A second electrode of the seventh transistor T7 is connected to the fourth node N4.

The second storage module 204 includes a second storage capacitor C2 and a third storage capacitor C3. A first electrode plate of the second storage capacitor C2 is connected to the third node N3. A second electrode plate of the second storage capacitor C2 and a first electrode plate of the third storage capacitor C3 are connected to the second light emitting device 205 through the fourth node N4. A second electrode plate of the third storage capacitor C3 is connected to the fifth node N5.

The second light emitting device 205 includes an organic light emitting diode D2. An anode of the organic light emitting diode D2 is connected to the fourth node N4. A cathode of the organic light emitting diode D2 is provided with the second power signal EVSS.

In this embodiment, one of the first electrode and the second electrode of each transistor is a source and the other is a drain. The first power signal EVDD is a high potential signal. A second power signal EVSS is a low potential signal. A voltage value output by the first power signal EVDD is greater than a voltage value output by the second power signal EVSS. In the second drive module 203, the fifth transistor T5 is a drive transistor. A threshold voltage of the second drive module 203 means a threshold voltage Vth of the fifth transistor T5.

Figure 5:
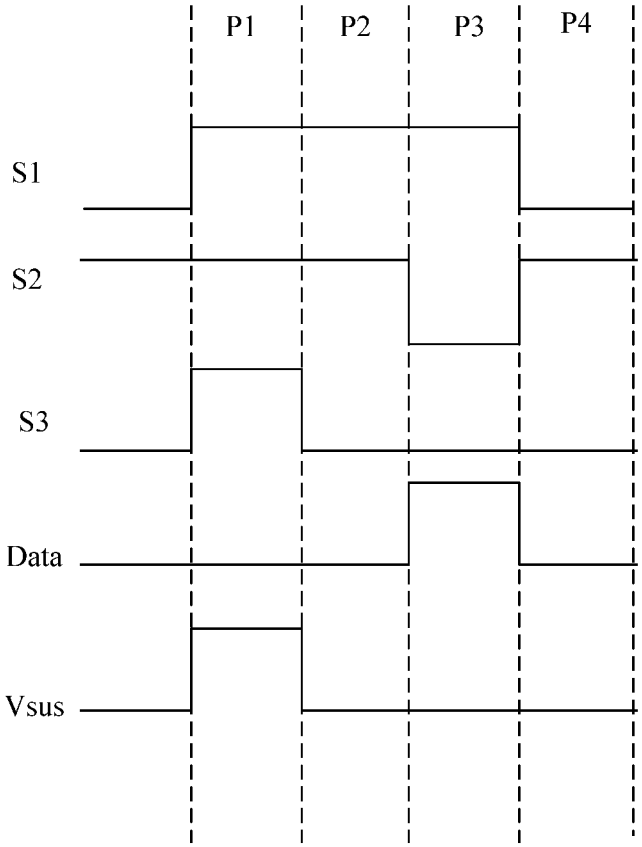
FIG. 5 is a timing diagram showing a detection stage of the second pixel driving circuit of the embodiment of the present disclosure.

FIG. 5 is a timing diagram showing a detection stage of the second pixel driving circuit of the embodiment of the present disclosure. The detection stage of the second pixel driving circuit is usually performed during a blank time period between adjacent display frames. The detection stage and the display stage together form a complete operating stage. The detection stage includes a reset stage P1 and a threshold voltage acquire stage P2. The display stage includes a data writing stage P3 and a light emitting stage P4.

In the reset stage P1, the third control signal S1 is at a high level. The fourth transistor T4 is turned on. The data line Data inputs a high potential reference voltage Vref to the third node N3. At this time, a potential of the third node N3 is $V_{N3}$=Vref. The fourth control signal S2 is at a high level. The sixth transistor T6 is turned on. The fifth control signal S3 is at a high level. The seventh transistor T7 is turned on. A second initial voltage Vsus with high potential is input to the fourth node N4. At this time, a potential of the fourth node N4 is $V_{N4}$=Vsus.

In the threshold voltage acquire stage P2, the third control signal S1 and the fourth control signal S2 are still at the high level. The fourth transistor T4 and the sixth transistor T6 are turned on. The fifth control signal S3 is at a low level. The seventh transistor T7 is turned off. At this time, a potential of the third node N3 is $V_{N3}$=Vref. Due to effects of the second storage capacitor C2 and the third storage capacitor C2, the potential of the fourth node N4 will change accordingly until the fifth transistor T5 is turned off.

The first electrode of the fifth transistor T5 starts charging from the Vsus value of the previous stage. The potential $V_{N4}$ of the fourth node N4 gradually rises until Vref−$V_{N4}$=Vth to complete the charging. Then, Vth is stored on both sides of the second storage capacitor C2.

In the data writing stage P3, the third control signal S1 is at a high level. The fourth transistor T4 is turned on. The fourth control signal S2 and fifth control signal S3 are at a low level. The sixth transistor T6 and the seventh transistor T7 are turned off. The data line Data inputs a high potential third data signal Vdata to the third node N3. At this time, a potential of the third node N3 is $V_{N3}$=Vdata. In comparison with the previous stage, a potential change of the third node N3 is Vdata-Vref. Due to a common coupling of the second storage capacitor C2 and the third storage capacitor C3, a potential of the fourth node N4 is $V_{N4}$=(Vref−Vth)+(Vdata−Vref)*C2/(C2+C3), where C2 is a capacitance value of the second storage capacitor, and C3 is a capacitance value of the third storage capacitor.

In the light emitting stage P4, the third control signal S1 and the fifth control signal S3 are at a low level. The fourth transistor T4 and the seventh transistor T7 are turned off. The fourth control signal S2 is at a high level. The sixth transistor T6 is turned on. A potential of the third node N3 is $V_{N3}$=Vdata. The fifth transistor T5 is turned on. The second light emitting diode D2 emits light under a potential control of the fourth control signal S2 and the third node N3. At this time, a formula of a current I(D) flowing through the second light emitting diode D2 is:

$$I(D)=\tfrac{1}{2}*K(V_{N3}-V_{N4}-Vth)^2$$

At this time, $V_{N3}$=Vdata, and $V_{N4}$=(Vref−Vth)+(Vdata−Vref)*C2/(C2+C3), put the two into the formula, and a result is:

$$I(D)=\tfrac{1}{2}*K((V\text{data}-V\text{ref})*C2/(C2+C3)-\text{Vref})^2$$

K is an intrinsic conductivity factor of the fifth transistor T5, which is a drive thin film transistor. It can be seen that the current flowing through the second light emitting diode D2 has nothing to do with the threshold voltage Vth of the fifth transistor T5. In this way, a threshold voltage compensation of the transistor in the non-bending area of the OLED display panel is realized, and an influence of a drift of the threshold voltage Vth of the drive transistor on the light emitting diode D is eliminated, so that the brightness of the display panel in the non-bending area is uniform.

It can be seen from the above analysis that compensation principles of the first pixel driving circuit and the second pixel driving circuit are different. The first pixel driving circuit directly senses the threshold voltage and then calculates the compensation value. The compensation value is directly compensated to the drive transistor through the data line Data. Moreover, the first pixel driving circuit is sensed during the first time period before starting up or the second time period after shutting down, and is not affected by a display time period. Therefore, there is enough time for compensation, and the compensation range is larger. The second pixel driving circuit removes factors related to the threshold voltage in the formula by inputting the reference voltage and the second initial voltage, so that the current has nothing to do with the threshold voltage of the drive transistor. Since the driving of the second pixel driving circuit is performed during the blank time period between the adjacent display frames, a time for acquiring and storing the threshold voltage is very short, so the compensation range is small.

Based on the difference between the compensation range of the OLED display panel in the bending area and the non-bending area, the first pixel driving circuit is used in the bending area, and the compensation is performed in the first time period before starting up or the second time period after shutting down. The compensation range is large, which can meet compensation requirements of transistors with large threshold voltage changes in this area. The second pixel driving circuit is used in the non-bending area. The compensation is carried out during the blank time period between the adjacent display frames. The compensation range is small. It can meet compensation requirements of transistors with small threshold voltage changes in this area. The two are used in conjunction with each other to make the brightness of the bending area and the non-bending area consistent, thereby achieving uniform brightness of an entire display panel.

The present disclosure also provides a display device including an OLED display panel and a driver chip, and the OLED display panel is the OLED display panel described in any of the above embodiments.

The following can be understood from the above embodiments.

The embodiments of the present disclosure provide the OLED display panel and the display device. The OLED display includes the bending area and the non-bending area. The OLED display panel includes the first pixel driving circuit and the second pixel driving circuit. The first pixel driving circuit is configured to compensate the threshold voltage of the drive transistor in the bending area during the first time period before starting up or the second time period after shutting down. The second pixel driving circuit is configured to compensate the threshold voltage of the drive transistor in the non-bending area during the blank time period between adjacent display frames. The duration of the first time period and the duration of the second time period are both greater than the duration of the blank time period. The present disclosure compensates the threshold voltage by using different pixel drive circuits for the bending area and the non-bending area. Since a compensation time of the first pixel driving circuit in the bending area is longer, a compensation voltage range will be larger, so it can meet compensation range requirements in the bending area. Thus, a brightness of the bending area and a brightness of the non-bending area are the same, so that the brightness of an entire display panel is uniform.

In the foregoing embodiments, descriptions of these embodiments have different emphases, and for parts that are not described in detail in one embodiment, refer to the related descriptions in the other embodiments.

The above describes in detail the OLED display panel and the display device of the embodiments of the present disclosure. In this specification, specific examples are configured to illustrate the principle and implementation of the present disclosure. The description of the above embodiments is only configured to help understand the technical solutions of the present disclosure and its core idea. Those of ordinary skill in the art should understand that they can still modify the technical solutions described in the foregoing embodiments, or equivalently replace some of the technical features. These modifications or replacements do not cause the essence of the corresponding technical solutions to deviate from the scope of the technical solutions of the embodiments of the present disclosure.

What is claimed is:

1. An organic light emitting diode (OLED) display panel, comprising:

a bending area and a non-bending area;

a first pixel driving circuit configured to compensate a threshold voltage of a drive transistor in the bending area during a first time period before starting up or a second time period after shutting down; and a second pixel driving circuit configured to compensate a threshold voltage of a drive transistor in the non-bending area during a blank time period between adjacent display frames, wherein a duration of the first time period and a duration of the second time period are both greater than a duration of the blank time period;

wherein the second pixel driving circuit comprises a second data signal input module, a second drive module, a second detection module, and a second storage module;

the second data signal input module is configured to provide a reference voltage signal to a third node in a threshold voltage acquire stage and to provide a third data signal to the third node in a data writing stage under control of a third control signal;

the second drive module is configured to drive a second light emitting device to emit light under control of a fourth control signal and a potential of the third node;

the second detection module is connected to the second drive module through a fourth node, and is configured to detect a threshold voltage of the second drive module in the threshold voltage acquire stage under control of a fifth control signal; and the second storage module is connected to the second drive module through the third node and a fifth node, and is configured to store the threshold voltage of the second drive module.

2. The OLED display panel as claimed in claim 1, wherein the first pixel driving circuit comprises a first data signal input module, a first drive module, a first detection module, and a first storage module;

the first data signal input module is configured to provide a first data signal to a first node under control of a first control signal;

the first drive module is configured to drive a first light emitting device to emit light under control of a potential of the first node;

the first detection module is connected to the first drive module through a second node, and is configured to detect a threshold voltage of the first drive module under control of a second control signal;

the first storage module is connected to the first drive module through the first node and the second node, and is configured to store the threshold voltage of the first drive module; and the first data signal input module is also configured to provide a compensated second data signal to the first node according to the threshold voltage detected by the first detection module.

3. The OLED display panel as claimed in claim 2, wherein the first data signal input module comprises a first transistor, a gate of the first transistor is connected to the first control signal, a first electrode of the first transistor is connected to a data line, and a second electrode of the first transistor is connected to the first node.

4. The OLED display panel as claimed in claim 3, wherein the first drive module comprises a second transistor, a gate of the second transistor is connected to the first node, a first electrode of the second transistor is connected to a first power signal, and a second electrode of the second transistor is connected to the first light emitting device.

5. The OLED display panel as claimed in claim 4, wherein the first detection module comprises a third transistor, a sensing line, and a single-pole double-throw switch, a gate of the third transistor is connected to the second control signal, a first electrode of the third transistor is connected to the second node, a second electrode of the third transistor is connected to a first terminal of the sensing line, a movable contact of the single-pole double-throw switch is connected to a second terminal of the sensing line, a first stationary contact of the single-pole double-throw switch is connected to a first initial voltage signal, and a second stationary contact of the single-pole double-throw switch is connected to an analog-to-digital converter.

6. The OLED display panel as claimed in claim 5, wherein the first storage module comprises a first storage capacitor, a first electrode plate of the first storage capacitor is connected to the first node, and a second electrode plate of the first storage capacitor is connected to the second node.

7. The OLED display panel as claimed in claim 1, wherein the second data signal input module comprises a fourth transistor, the second drive module comprises a fifth transistor and a sixth transistor, a gate of the fourth transistor is connected to the third control signal, a first electrode of the fourth transistor is connected to a data line, a second electrode of the fourth transistor is connected to the third node, a gate of the fifth transistor is connected to the third node, a first electrode of the fifth transistor is connected to the second light emitting device, a second electrode of the fifth transistor is connected to a first electrode of the sixth transistor, a gate of the sixth transistor is connected to the fourth control signal, and a second electrode of the sixth transistor is connected to a first power signal through the fifth node.

8. The OLED display panel as claimed in claim 7, wherein the second detection module comprises a seventh transistor, a gate of the seventh transistor is connected to the fifth transistor, a first electrode of the seventh transistor is connected to a second initial voltage signal, and a second electrode of the seventh transistor is connected to the fourth node.

9. The OLED display panel as claimed in claim 8, wherein the second storage module comprises a second storage capacitor and a third storage capacitor, a first electrode plate of the second storage capacitor is connected to the third node, a second electrode plate of the second storage capacitor and a first electrode plate of the third storage capacitor are connected to the second light emitting device through the fourth node, and a second electrode plate of the third storage capacitor is connected to the fifth node.

10. A display device, comprising an organic light emitting diode (OLED) display panel and a driver chip, wherein the OLED display panel comprises:

a bending area and a non-bending area;

a first pixel driving circuit configured to compensate a threshold voltage of a drive transistor in the bending area during a first time period before starting up or a second time period after shutting down; and a second pixel driving circuit configured to compensate a threshold voltage of a drive transistor in the non-bending area during a blank time period between adjacent display frames, wherein a duration of the first time period and a duration of the second time period are both greater than a duration of the blank time period;

wherein the second pixel driving circuit comprises a second data signal input module, a second drive module, a second detection module, and a second storage module;

the second data signal input module is configured to provide a reference voltage signal to a third node in a threshold voltage acquire stage and to provide a third data signal to the third node in a data writing stage under control of a third control signal;

the second drive module is configured to drive a second light emitting device to emit light under control of a fourth control signal and a potential of the third node;

the second detection module is connected to the second drive module through a fourth node, and is configured to detect a threshold voltage of the second drive module in the threshold voltage acquire stage under control of a fifth control signal; and the second storage module is connected to the second drive module through the third node and a fifth node, and is configured to store the threshold voltage of the second drive module.

11. The display device as claimed in claim 10, wherein the first pixel driving circuit comprises a first data signal input module, a first drive module, a first detection module, and a first storage module;

the first data signal input module is configured to provide a first data signal to a first node under control of a first control signal;

the first drive module is configured to drive a first light emitting device to emit light under control of a potential of the first node;

the first detection module is connected to the first drive module through a second node, and is configured to detect a threshold voltage of the first drive module under control of a second control signal;

the first storage module is connected to the first drive module through the first node and the second node, and is configured to store the threshold voltage of the first drive module; and the first data signal input module is also configured to provide a compensated second data signal to the first node according to the threshold voltage detected by the first detection module.

12. The display device as claimed in claim 11, wherein the first data signal input module comprises a first transistor, a gate of the first transistor is connected to the first control signal, a first electrode of the first transistor is connected to a data line, and a second electrode of the first transistor is connected to the first node.

13. The display device as claimed in claim 12, wherein the first drive module comprises a second transistor, a gate of the second transistor is connected to the first node, a first electrode of the second transistor is connected to a first power signal, and a second electrode of the second transistor is connected to the first light emitting device.

14. The display device as claimed in claim 13, wherein the first detection module comprises a third transistor, a sensing line, and a single-pole double-throw switch, a gate of the third transistor is connected to the second control signal, a first electrode of the third transistor is connected to the second node, a second electrode of the third transistor is connected to a first terminal of the sensing line, a movable contact of the single-pole double-throw switch is connected to a second terminal of the sensing line, a first stationary contact of the single-pole double-throw switch is connected to the first initial voltage signal, and a second stationary contact of the single-pole double-throw switch is connected to an analog-to-digital converter.

15. The display device as claimed in claim 14, wherein the first storage module comprises a first storage capacitor, a first electrode plate of the first storage capacitor is connected to the first node, and a second electrode plate of the first storage capacitor is connected to the second node.

16. The display device as claimed in claim 10, wherein the second data signal input module comprises a fourth transistor, the second drive module comprises a fifth transistor and a sixth transistor, a gate of the fourth transistor is connected to the third control signal, a first electrode of the fourth transistor is connected to a data line, a second electrode of the fourth transistor is connected to the third node, a gate of the fifth transistor is connected to the third node, a first electrode of the fifth transistor is connected to the second light emitting device, a second electrode of the fifth transistor is connected to a first electrode of the sixth transistor, a gate of the sixth transistor is connected to the fourth control signal, and a second electrode of the sixth transistor is connected to a first power signal through the fifth node.

17. The display device as claimed in claim 16, wherein the second detection module comprises a seventh transistor, a gate of the seventh transistor is connected to the fifth transistor, a first electrode of the seventh transistor is connected to a second initial voltage signal, and a second electrode of the seventh transistor is connected to the fourth node.

18. The display device as claimed in claim 17, wherein the second storage module comprises a second storage capacitor and a third storage capacitor, a first electrode plate of the second storage capacitor is connected to the third node, and a second electrode plate of the second storage capacitor and a first electrode plate of the third storage capacitor are connected to the second light emitting device through the fourth node, and a second electrode plate of the third storage capacitor is connected to the fifth node.

* * * * *